United States Patent [19]

Waters

[11] 4,314,452

[45] Feb. 9, 1982

[54] COMPRESSOR DISCHARGE CONVERTER

[75] Inventor: Michael A. Waters, Elk Grove Village, Ill.

[73] Assignee: Application Engineering Corporation, Elk Grove Village, Ill.

[21] Appl. No.: 172,956

[22] Filed: Jul. 28, 1980

[51] Int. Cl.[3] ..... F25B 45/00; F25B 27/02

[52] U.S. Cl. ..... 62/77; 62/183; 62/238.6; 62/299

[58] Field of Search ..... 62/183, 238.6, 77, 298, 62/299

[56] References Cited

U.S. PATENT DOCUMENTS

| | | | |
|---|---|---|---|
| 1,874,803 | 8/1932 | Reed | 62/238.6 X |
| 2,657,543 | 11/1953 | Eichmann | 62/183 X |
| 2,934,915 | 5/1960 | Morse | 62/299 |
| 3,091,945 | 6/1963 | Morse | 62/299 |
| 3,481,152 | 12/1969 | Seeley | 62/183 X |
| 4,123,914 | 11/1978 | Perez et al. | 62/238.6 X |
| 4,178,769 | 12/1979 | Johnsen | 62/238.6 X |
| 4,226,606 | 10/1980 | Yaeger et al. | 62/238.6 |
| 4,251,996 | 2/1981 | Esformes et al. | 62/183 X |
| 4,254,630 | 3/1981 | Geary | 62/238.6 X |

*Primary Examiner*—Lloyd L. King
*Attorney, Agent, or Firm*—Kinzer, Plyer, Dorn & McEachran

[57] ABSTRACT

A converter for connecting a second condenser in series in a process fluid chilling loop system including a compressor, a discharge service valve mounted on the compressor outlet, a condenser, and a refrigerant-to-process fluid heat exchanger. The converter includes a housing, mounted on the compressor interposed between the compressor outlet and the discharge service valve, which includes first and second separate transfer chambers. The first transfer chamber connects directly to the compressor discharge port and the second transfer chamber connects directly to the discharge service valve. Each transfer chamber is connected to an external port on the housing by a plurality of small tunnel passages, thereby affording a thin, flat converter for connecting a second condenser in series with the system. An inclined web that extends from an annular wall on one side of the housing to an annular wall on the other side of the housing divides the housing into the first and second separate transfer chambers.

5 Claims, 4 Drawing Figures

COMPRESSOR DISCHARGE CONVERTER

BACKGROUND OF THE INVENTION

This invention relates to a converter for the adaption of a water condensed refrigeration system, such as the type of system used in an industrial water chiller, to permit operation in a water condensation mode, an air condensation mode, or a combination air/water condensation mode. Although the converter may be incorporated in new equipment, this invention is particularly intended for use in the adaptation of existing chiller systems to the utilization of an additional air cooled condenser with minimum modification of the existing piping.

Water condensed refrigeration systems are commonly employed in industrial water chillers which are used for the cooling of the operating parts of industrial equipment. The high pressure refrigerant gas leaving the compressor in such a system is condensed in a water-cooled condenser; in most installations the heat of condensation is, for all practical purposes, wasted. In these times of high energy costs, it is desirable to utilize the heat given off by the condensation of the refrigerant gas.

One way to use this heat is to employ an air cooled condenser for the refrigerant gas and use this condenser as a space heater for the plant. Because such a space heater would not be utilized during the warmer months of the year, it is generally considered necessary that such an air cooled condenser be connected in series with the existing water cooled condenser so that condensing capacity is provided during the warmer months of the year. In the past, the addition of an air cooled condenser in series with an existing condenser required the disconnection and connection of many joints and fittings in the refrigerant conduit, most of which were soldered. An addition of this type required considerable work and expense along with the inherent danger of leakage and loss of the refrigerant gas.

SUMMARY OF THE INVENTION

It is an object of the invention, therefore, to provide a converter which permits the easy installation of an air cooled condenser in series in a process fluid chilling system of the kind utilizing a water cooled condenser.

Another object of the invention is to provide a converter which is easily mountable on the compressor, between the compressor outlet and the discharge service valve of the system.

Another object of this invention is to provide an air cooled condenser in series with a water cooled condenser in a process fluid chilling system in which the air cooled condenser can be used as a heat exchanger to provide heat for climate control or other purposes when it is needed.

Accordingly, the invention relates to an improvement in a process fluid chilling system of the kind comprising a compressor, a discharge service valve mounted on the discharge port of the compressor, a condenser and a refrigerant to process fluid heat exchanger which are connected together in the stated sequence by refrigerant conduits which comprises a compressor discharge converter for connecting a second condenser into the system in series. The compressor discharge converter includes a housing which is mountable on the compressor interposed between the compressor outlet and the discharge service valve. The housing provides first and second separate transfer chambers, each chamber having a central port at the center of the converter and an external port at the periphery of the converter, the central port of the first transfer chamber connected directly to the compressor discharge port and the central port of the second transfer chamber connected directly to the discharge service valve. The central port of each transfer chamber is connected to the external port of that chamber by a plurality of small tunnel passages thereby affording a thin, flat converter for connecting a second condenser in series in the system.

DETAILED DESCRIPTION OF THE PREFERRED EMBODIMENT

Figure 1:
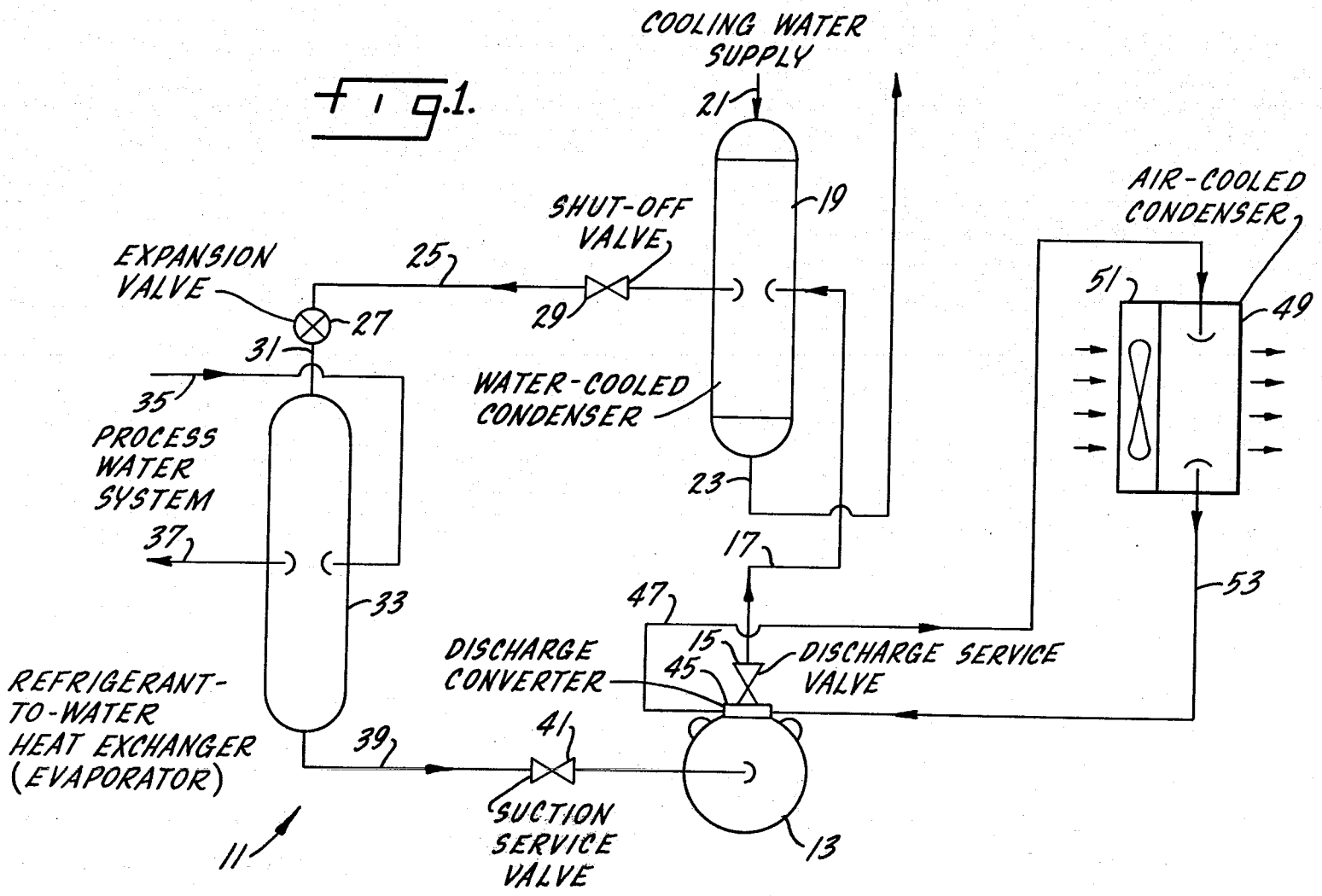
FIG. 1 is a schematic view showing the invention incorporated into an industrial process fluid chilling system.

FIG. 1 of the drawings shows an industrial process fluid chilling system 11. For simplicity of description, it will be assumed that the process fluid, as is conventional, is water, although it should be understood that other fluids may also be chilled as part of an industrial fluid chilling process. The chilling fluid is used to cool operating parts of machinery of various types.

The process fluid chilling system 11 includes a compressor 13 having a discharge service valve 15. A refrigerant conduit 17 connects the discharge service valve to a water cooled condenser 19. This condenser has a cooling water inlet 21 and a cooling water outlet 23. A refrigerant conduit 25 leads from the water cooled condenser to an expansion valve 27. A shut-off valve 29 is installed in this conduit between the condenser and the expansion valve.

A refrigerant conduit 31 connects the expansion valve 27 to an evaporator 33. The evaporator is of the refrigerant to water heat exchanger type. A process fluid inlet 35, which in this case is water, leads into the evaporator 33 and a process fluid outlet 37 carries the chilled water out of the evaporator. A refrigerant conduit 39 leads from the evaporator 33 to the compressor 13 and a suction service valve 41 is installed in this conduit.

The apparatus as heretofore described is that of a conventional process fluid chilling system. In accordance with the teachings of this invention, the chilling system is modified to accept an additional air cooled condenser in series with the existing water cooled condenser 19. This is accomplished by the provision of a compressor discharge converter 45 which is mounted on the compressor discharge port. A refrigerant conduit 47 leads from the converter to an air cooled condenser 49. A fan 51 is provided to move air through the condenser 49 and this fan may be controlled manually or by a thermostat (not shown). A refrigeration conduit 53 connnects the air cooled condenser 49 with a return inlet of the discharge converter 45.

Figure 2:
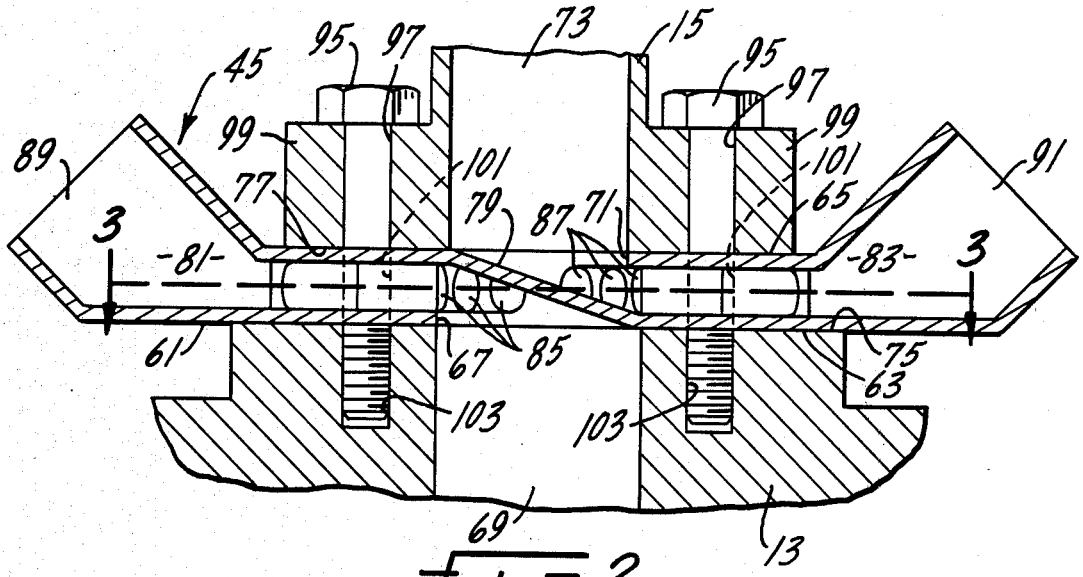
FIG. 2 is an enlarged vertical cross-sectional view taken through the converter of this invention, taken approximately along line 2—2 of FIG. 3.
Figure 3:
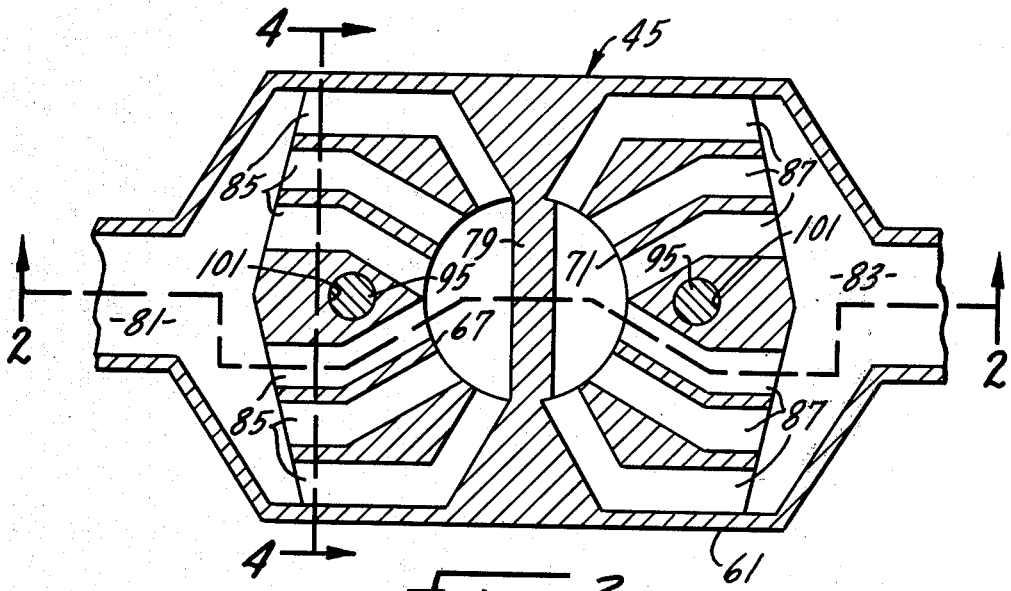
FIG. 3 is an enlarged horizontal cross-sectional view taken through the converter of this invention, taken approximately along line 3—3 of FIG. 2.
Figure 4:
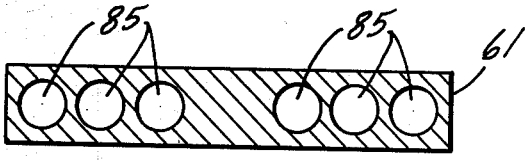
FIG. 4 is a cross-sectional view taken approximately along line 4—4 of FIG. 3.

The compressor discharge converter 45 is shown in detail in FIGS. 2, 3 and 4 of the drawings. The converter is preferably a casting in the form of a somewhat rectangular housing 61 which is generally thin and flat. The housing has somewhat annular walls 63 and 65 located on opposite flat surfaces thereof. The annular wall 63 surrounds an inlet port 67 which connects directly to the compressor discharge port 69. The annular wall 65 surrounds an outlet port 71 which communicates directly with the inlet 73 of the discharge service valve 15. The annular wall 63 seats on an annular wall 75 surrounding the compressor discharge port while the annular wall 65 is seated against an annular surface 77 surrounding the service valve inlet 73.

An inclined web 79 extends between the walls 63 and 65 to separate the ports 67 and 71, thereby forming a first transfer chamber 81 and a second transfer chamber 83. Each transfer chamber consists of a plurality of tunnel passages 85 and 87 respectively. The passages 85 lead from the inlet port 67 to a port 89 which connects with the refrigerant conduit 47 leading to the air cooled condenser 49. The passages 87 lead from an inlet port 91, which connects to the refrigerant conduit 53 extending from the condenser 49, to the outlet opening 71.

The housing 61 is secured between the compressor 13 and the discharge service valve 15 by bolts 95 which extend through passages 97 formed in flanges 99 of the discharge service valve, through passages 101 formed in the housing, and into threaded holes 103 formed in the compressor. The discharge service valve 15 is normally fastened to the compressor 13 by such bolts, and the only additional change made after the installation of the housing 61 is the provision of bolts 95 which are longer by an amount equal to the thickness of the housing 61.

The procedure followed in installing the discharge converter 45 and the auxiliary condenser 49 in system 11 is simple and convenient. First, the suction service valve 41 is closed and compressor 13 is maintained operational for a short period of time to get all of the refrigerant out of the compressor. Next, the discharge service valve 15, still connected directly to the outlet of compressor 13, is closed, sealing the refrigerant in the portion of the system from conduit 17 to conduit 31, following which the discharge service valve is disconnected from the compressor. At this stage it is advisable to defer further action for about two hours to allow for removal of refrigerant from the oil in the compressor.

The converter 45 is now slipped into place on compressor 13, between the compressor outlet and the discharge service valve 15. The thin, flat configuration of converter 45 makes this readily possible even in those systems, quite common in the field, in which the compressor and discharge service valve are mounted in an assembly affording only limited space. Valves 15 and 41 are opened and the system is ready for operation, allowing re-use of heat from the system during cool weather, via the air cooled condenser 49, with little or no loss of efficiency in warm weather when the air cooled condenser is shut down, as by de-energizing fan 51, so that only the main condenser 19 is employed.

Although the invention has been described for use in a water condensed refrigeration system, it should be understood that it could also be used in an air condensed refrigeration system in which a principal air cooled condenser, replacing condenser 19, would be located out of doors or in a location where the heat of condensation could not readily be used for environmental control.

I claim:

1. In a process fluid chilling system of the kind comprising a compressor, a discharge service valve mounted on the discharge port of the compressor, a condenser and a refrigerant-to-process fluid heat exchanger connected together in the stated sequence by refrigerant conduits, the improvement comprising a compressor discharge converter for connecting a second condenser into the system in series, comprising:

a housing mountable on the compressor interposed between the compressor outlet and the discharge service valve, the housing comprising first and second separate transfer chambers, each chamber having a central port at the center of the converter and an external port at the periphery of the converter, the central port of the first transfer chamber connecting directly to the compressor discharge port and the central port of the second transfer chamber connecting directly to the discharge service valve, the central port of each transfer chamber being connected to the external port of that chamber by a plurality of small tunnel passages thereby affording a thin, flat configuration for the converter;

and conduit means connecting the external ports of the converter to a second condenser so that the second condenser is connected in the system in series with the first condenser.

2. The apparatus of claim 1 in which the housing includes annular walls located on opposite facing sides of the housing and each surrounding a central converter port, with one housing annular wall adapted to engage an annular surface surrounding the compressor discharge port and the other housing annular wall adapted to engage an annular surface on the discharge service valve, and an inclined web extending from the annular wall on one side of the housing to the annular wall on the other side of the housing, the inclined web extending across the inlets and dividing the housing into the first and second separate transfer chambers.

3. The apparatus of claim 1 or claim 2 in which the second condenser is an air cooled condenser suitable for space heating use.

4. A converter for connecting a second condenser in series in a process fluid chilling system of the kind having a compressor, a discharge service valve mounted on the discharge port of the compressor, a first condenser, and a refrigerant-to-process fluid heat exchanger, connected together, the converter including:

a housing mounted on the compressor interposed between the compressor outlet and the discharge service valve, the housing including first and second separate transfer chambers, each chamber having a central port at the center of the converter and an external port at the periphery of the converter, the central port of the first transfer chamber connecting directly to the compressor discharge port and the central port of the second transfer chamber connecting directly to the discharge service valve, the central port of each transfer chamber being connected to the external port of that chamber by a plurality of small tunnel passages thereby affording a thin, flat converter for connecting a second condenser in series with the system.

5. The converter of claim 4 in which the housing includes annular walls located on opposite facing sides of the housing and each surrounding a central converter port, with one housing annular wall adapted to engage an annular surface surrounding the compressor discharge port and the other housing annular wall adapted to engage an annular surface on the discharge service valve, and an inclined web extending from the annular wall on one side of the housing to the annular wall on the other side of the housing, the inclined web extending across the inlets and dividing the housing into the first and second separate transfer chambers.

* * * * *